United States Patent [19]

Fujio

[11] 4,004,705

[45] Jan. 25, 1977

[54] CAPSULE OR SEAL CARRYING A CERTIFICATE STAMP OR THE LIKE THEREIN

[76] Inventor: Masaaki Fujio, 3-15-8, Aoyamadai, Suita, Osaka, Japan

[22] Filed: June 12, 1975

[21] Appl. No.: 586,182

[30] Foreign Application Priority Data

July 18, 1974 Japan ..... 49-81699

[52] U.S. Cl. ..... 215/246; 40/310

[51] Int. Cl.[2] ..... B65D 41/54

[58] Field of Search ..... 215/246, 230, 228, 232, 215/256; 40/306, 310, 106.1

[56] References Cited

UNITED STATES PATENTS

| | | | |
|---|---|---|---|
| 2,361,464 | 10/1944 | Edwards | 215/246 |
| 2,863,582 | 12/1958 | Owens | 215/246 |
| 3,024,934 | 3/1962 | Dreiss | 215/256 |
| 3,746,201 | 7/1973 | Fujio | 215/246 |
| 3,827,591 | 8/1974 | Spelman | 215/246 |
| 3,951,292 | 4/1976 | Amberg | 215/232 |

*Primary Examiner*—Ro E. Hart

*Attorney, Agent, or Firm*—Kleinberg, Morganstern, Scholnick & Mann

[57] ABSTRACT

A capsule made from a heat-shrinkable film by overlapping and bonding ends of said film to form a cylindrical body such that a non-bonded overlapping portion provided between the bonded ends of the film, then inserting a certificate stamp or the like into said non-bonded overlapping portion and forming guide lines for cutting in crossed relation with said certificate stamp or the like.

18 Claims, 6 Drawing Figures

CAPSULE OR SEAL CARRYING A CERTIFICATE STAMP OR THE LIKE THEREIN

This invention relates to a capsule or seal made from a heat-shrinkable film and carrying a certificate stamp or the like therein, and more particularly, to a capsule which is formed by overlapping and bonding ends of the heat-shrinkable film so as to provide a non-bonded overlapping portion between the bonded ends, then inserting a certificate stamp or the like into the non-bonded overlapping portion.

A tax stamp or other like certificate stamp is affixed, in most cases, to a mouth of a bottle for alcoholic drinks. Such stamp is usually made of a thin slip of paper and pasted by an adhesive so as to span over a stopper and a body of the bottle and to be torn out with unstopping of the bottle so that it is not re-used.

Such stamp, however, is liable to peel off when for instance wetted with water, and some wicked dealers avail of intentionally stripping off the stamp in order to re-use it unlawfully. Also, it takes considerable time and labor to affix such stamps, and further, there is high probability that they should be soiled or damaged during storage or transport.

The present invention relates to a capsule for use with a tax stamp or the like, which is perfectly free of the above-mentioned problems of the conventional ones. The capsule according to the present invention is characterized in that ends of a heat-shrinkable film are overlapped and bonded so as to form a cylindrical body and to provide a non-bonded overlapping portion between the bonded ends and then a stamp or the like is placed and fixed into the non-bonded overlapping portion of the film, with cutting guide lines such as perforations being formed in crossed relation with said stamp.

The present invention is described in detail hereinbelow by way of some preferred embodiments thereof with reference to the accompanying drawings.

Figure 1:
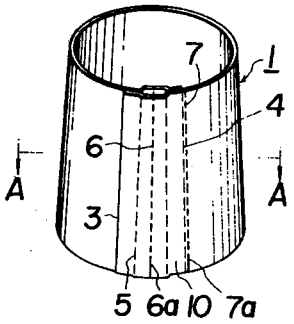
FIG. 1 is a perspective view of the first embodiment of a capsule incorporating a stamp according to the present invention.
Figure 2:
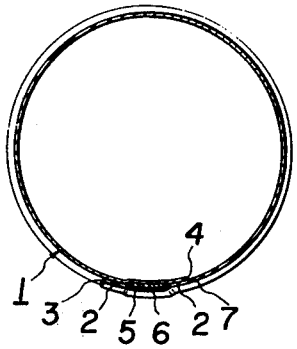
FIG. 2 is an enlarged cross-sectional plane view taken along the line A—A of FIG. 1.

Referring first to FIGS. 1 and 2, there is shown a capsule, generally indicated by numeral 1, which has been formed by overlapping ends 3, 4 of a heat-shrinkable film and bonding said ends at the parts 2, 2 such that a non-bonded overlapping portion is provided between the bonded ends 2, 2. A tax stamp 5 or the like of any shape is inserted into said non-bonded overlapping portion. This stamp is shown as a strip elongated axially of the capsule 1 in the accompanying drawings showing embodiments of the present invention, however, such stamp may be of any other geometrical configuration. Also, this stamp may be of any type such as a tax stamp, a trading stamp, etc., and it may be made of a plastic film, metal foil or the like as well as a paper strip. A front side or a back side or the both sides of the stamp 5 may be suitably bonded to the cylindrical capsule 1 itself. It is to be also noted that the perforated lines 6, 7 for cutting are provided to pierce through both the front and back sides of the cylindrical capsule 1 and to extend axially along the central part and along a suitable part on or near one side of the stamp 5 respectively. Lower ends of said perforated lines 6 and 7 form into somewhat elongated continuous perforations 6*a* and 7*a* respectively, as shown in FIG. 1.

Figure 3:
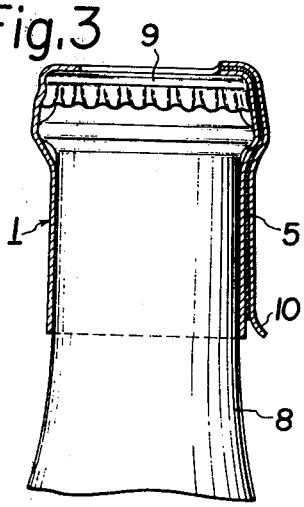
FIG. 3 is a longitudinal sectional side view showing a mode of use of the first embodiment shown in FIGS. 1 and 2.

In use the above-described capsule of the present invention is first placed over a mouth of a bottle 8 such that an upper edge thereof slightly projects out from a top surface of a stopper 9 of the bottle 8 shown in FIG. 3, and then said capsule is heat-shrunk, whereby the capsule is stuck fast to the mouth of the bottle 8 as well as to lateral and upper peripheral parts of the stopper 9, thereby perfectly sealing the bottle 8. When the capsule is heat-shrunk, a portion 10 positioned between the somewhat elongated continuous perforations 6*a* and 7*a* at the lower ends of the perforated lines 6 and 7 is unshrunk and stays slightly projecting outwardly and upwardly. Therefore, when it is desired to break the capsule, one may grip and pull outwardly the above-mentioned upwardly projecting portion 10, thereby breaking the capsule. The stamp 5 is also automatically cut since tearing is effected along the perforations 6 that pass substantially the central part of the stamp.

Thus, according to the present invention, there is no possibility that the stamp should be damaged or stripped off during handling or transport or even if wetted with water. Also, it is quite impossible to peel off the stamp 5 alone without unstopping the bottle 8.

Figure 4:
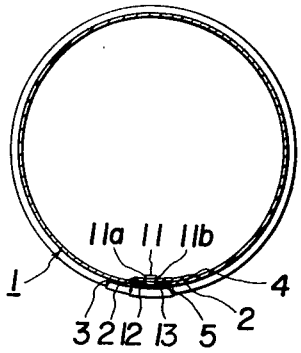
FIG. 4 is an enlarged cross-sectional plane view showing the second embodiment of the present invention.

FIG. 4 shows another embodiment of the present invention where a tear tape 11 is provided instead of the perforations 6 and 7 in the first embodiment. The tear tape 11 is considerably narrower in width than the stamp 5 and suitably stuck on the back side of the overlapped portion of the capsule 1 over its full length and along a part corresponding substantially to the center of the stamp 5. In this case, also an upper or a lower end of the tear tape 11 is suitably projected out from the capsule 1 so that one may break the capsule 1 and stamp 5 by gripping and pulling outwardly said projected portion. For facilitating breaking of the capsule, the perforations 12 and 13 piercing through both the front and back sides of the cylindrical capsule may be provided in front of both side edges 11*a* and 11*b* of the tear tape 11.

Figure 5:
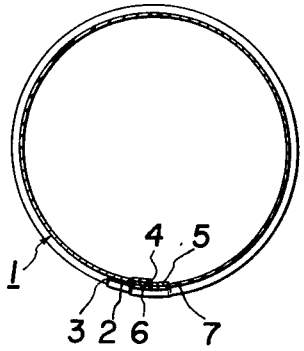
FIG. 5 is an enlarged cross-sectional plane view showing the third embodiment of the present invention.

In still another embodiment of the present invention shown in FIG. 5, the stamp 5 overlies the back side of the capsule slightly inward of the outer bonded end 3 of the capsule 1. The inner end 4 of the capsule 1 terminates substantially at the center of the stamp 5 in its widthwise direction and suitably is bonded to the back side of the stamp 5. As in the case of the first embodiment, the perforations 6 and 7 are provided respectively along the central part and along a suitable part on or near one side of the stamp 5. The capsule of this embodiment is used in the same way as those of the first and second embodiments.

Figure 6:
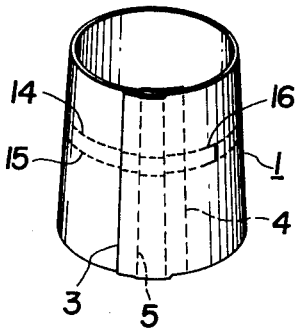
FIG. 6 is a perspective view showing the fourth embodiment of the present invention.

FIG. 6 shows the fourth embodiment of the present invention which is same as the first embodiment except that the perforations 14 and 15 for cutting are provided sidewise with a suitable space therebetween. At a suitable part of said both lines of perforations 14 and 15 there is provided a U-shaped continuous perforation 16 that connects to said both lines of perforations 14, 15.

In use of such capsule, the capsule is first fitted over the mouth of the bottle such that the portion encompassed by said both lines of perforations 14 and 15 is positioned in alignment with the bottom edge of the stopper, and then the capsule is heat-shrunk. The portion defined by the U-shaped continuous line 16 is left unshrunk to project slightly outwardly, so that one may grip and pull outwardly said portion when it is desired to cut the capsule, whereby the capsule 1 can be cut in halves, and the stamp is also cut laterally.

What is claimed is:

1. A capsule having a certificate stamp fixed therein characterized in that ends of a heat-shrinkable film are overlapped and bonded to form a cylindrical body such that a non-bonded overlapping portion is provided between the bonded ends, and said certificate stamp is placed into said non-bonded overlapping portion, and guide lines for cutting are provided in crossed relation with the certificate stamp.

2. The capsule as set forth in claim 1, wherein said guide lines for cutting are two lines of perforations.

3. The capsule according to claim 2, wherein one of said two lines of perforations is provided axially along the center of the certificate stamp in its widthwise direction and the other line is provided also axially at a suitable part near one side of the certificate stamp, and each lower end of said lines of perforations is formed into a somewhat elongated continuous perforation.

4. The capsule according to claim 2, wherein said two lines of perforations are provided sidewise with a suitable space therebetween, and slightly elongated continuous perforations are formed partly in both of said lines of perforations, said continuous perforation being connected to each other at one end.

5. The capsule of claim 1 further comprising a tear tape narrower in width than the certificate stamp, extending along a part on the backside of said overlapping portion substantially in correspondence with the center in the widthwise direction of the certificate stamp and extending over the full length of said overlapping portion in its axial direction, with an end of said tape being projected out from the cylindrical body.

6. The capsule as set forth in claim 5, wherein perforations piercing through both front and back sides of said non-bonded overlapping portion are provided in front of both side edges of said tape.

7. The capsule of claim 1, wherein an inner end of the film is positioned substantially at the center in the widthwise direction of the certificate stamp and suitably bonded to the backside of the certificate stamp.

8. The capsule as set forth in claim 7, wherein said guide lines for cutting are two lines of perforations.

9. The capsule according to claim 8, wherein one of said two lines of perforations is provided axially along the center of the certificate stamp in its widthwise direction and the other is provided also axially at a suitable part near one side of the certificate stamp, and each lower end of said lines of perforations is formed into a somewhat elongated continuous perforation.

10. The capsule according to claim 8, wherein said two lines of perforations are provided sidewise with a suitable space therebetween and at a predetermined region a U-shaped continuous perforation is provided that connects to said two lines of perforations.

11. A capsule having a certificate stamp fixed therein characterized in that both ends of a heat-shrinkable film are overlapped and bonded to form a cylindrical body such that a non-bonded overlapping portion is included between the bonded ends, and said certificate stamp is inserted into said non-bonded overlapping portion, and a tear tape narrower in width than the certificate stamp is stuck on the back side of said overlapping portion substantially in correspondence to the center in the widthwise direction of the certificate stamp and over the full length of said overlapping portion in its axial direction, with the upper and lower end of said tape being suitably projected out from the cylindrical body.

12. A seal having a certificate stamp fixed therein, comprising:

a heat-shrinkable film, one portion of which overlaps another portion defining an overlapped area, said film bonded to itself over at least a part of the periphery of said overlapped area, whereby a pocket is formed between the non-bonded overlapping portions, into which pocket the certificate stamp can be inserted; and, at least one guide line for severing the seal, said guide line extending across that portion of said film overlying the certificate stamp, whereby when the seal is severed the certificate stamp will be invalidated.

13. The seal of claim 12, wherein said guide lines comprise at least one row of perforations.

14. The seal of claim 13, wherein two rows of perforations are terminated in a U-shaped continuous perforation, whereby a removable strip having a pull-tab at one end is defined.

15. The seal of claim 12, further comprising a tear tape narrower in width than the certificate stamp, extending across that portion of said film underlying the certificate stamp, affixed to said film with at least one end extending beyond said film whereby when an appropriate force is applied between said tear tape and said seal, said seal will be severed and the certificate stamp will be invalidated.

16. The seal of claim 15, wherein said film further comprises two rows of perforations extending through it along the edges of said tear tape, whereby removal of a strip of said seal is facilitated.

17. The seal of claim 12, wherein a part of the overlapped portion of the film is bonded to one face of the certificate stamp and wherein the overlapping portion of said film includes a part which extends over the certificate stamp and is bonded to the overlapped portion of the film.

18. A seal having a certificate stamp fixed therein, comprising:

a heat-shrinkable film, one portion of which overlaps another portion defining an overlapped area, said film bonded to itself over at least a part of the periphery of said over-lapped area, whereby a pocket is formed between the non-bonded overlapping portions, into which pocket the certificate stamp can be inserted; and a tear tape narrower in width than the certificate stamp, extending across that portion of said film underlying the certificate stamp, affixed to said film with at least one end extending beyond said film, whereby when an appropriate force is applied between said tear tape and said seal, said seal will be severed and the certificate stamp will be invalidated.

* * * * *